US006283801B1

(12) United States Patent
Guinda et al.

(10) Patent No.: US 6,283,801 B1
(45) Date of Patent: Sep. 4, 2001

(54) ELASTIC TERMINAL IN AN ELECTRICAL DEVICE

(75) Inventors: Santos Guinda, Guichainville; Jacques Gourdon, Sartrouville; Claude Tocqueville, Le Plessis Grohan, all of (FR)

(73) Assignee: Schneider Electric Industries SA, Rueil-Malmaison (FR)

( * ) Notice: Subject to any disclaimer, the term of this patent is extended or adjusted under 35 U.S.C. 154(b) by 0 days.

(21) Appl. No.: 09/552,725

(22) Filed: Apr. 19, 2000

(30) Foreign Application Priority Data

Apr. 22, 1999 (FR) ..... 99 05221

(51) Int. Cl.[7] ..... H01R 4/48
(52) U.S. Cl. ..... 439/835; 439/787
(58) Field of Search ..... 439/822, 828, 439/834, 835, 838, 721

(56) References Cited

U.S. PATENT DOCUMENTS 4,767,340 8/1988 Hohorst ..... 439/729
5,816,867 * 10/1998 Davidsz et al. ..... 439/828
5,853,304 * 12/1998 Landreau et al. ..... 439/721
5,860,837 * 1/1999 Bock et al. ..... 439/828
5,879,204 * 3/1999 Delarue et al. ..... 439/835
6,004,168 * 12/1999 Fuchs et al. ..... 439/835
6,010,376 * 1/2000 Kollmann ..... 439/834

FOREIGN PATENT DOCUMENTS 44 13 151 10/1995 (DE) .
296 08 178 U 9/1996 (DE) .
19629563A1 * 1/1998 (DE) ..... 4/48

* cited by examiner

*Primary Examiner*—Neil Abrams
*Assistant Examiner*—Son V. Nguyen
(74) *Attorney, Agent, or Firm*—Oblon, Spivak, McClelland, Maier & Neustadt, P.C.

(57) ABSTRACT

A spring connection terminal for an electrical device includes a conducting support part fixed to a main conducting part, and at least one clamping spring folded into the form of a loop and provided with a clamping window inside which a flange of the support part passes, and includes a spring stop that is folded so as to be housed inside the spring loop and which forms a guide for guiding the wire adjacent to the flange.

7 Claims, 6 Drawing Sheets

ELASTIC TERMINAL IN AN ELECTRICAL DEVICE

BACKGROUND OF THE INVENTION

Field of the Invention

This invention relates to a spring controlled connection terminal for an electrical device composed of a conducting support part that is fixed to a main conducting part, and at least one clamping spring folded in the form of a loop and provided with a clamping window through which a flange of the support part passes.

Prior art includes an elastic terminal consisting of a spring folded in the form of a loop or a cage, in which one attachment flange is fixed to the conducting part of the support, and another flange is used to tighten the electrical wire and for the connection. The clamping flange is provided with an opening or a window in which the electrical wire is housed and which remains trapped between an edge of the said window and a flange of the conducting part of the support, due to the spring effect. The electrical wire is engaged in the chase or clamping window, by pressing on the looped spring using a screwdriver at the same time. For example, refer to patent EP 0 806 811 and patent DE 196 29 563 describing an elastic terminal in which a stop is housed inside the loop in order to prevent the spring from being compressed. In particular, permanent deformation of the spring must be avoided, since this would have unfortunate consequences on the contact between the electrical wire and the conducting support part.

The only function of stops used in looped springs at the present time is to prevent the spring from being compressed and permanently deformed.

SUMMARY OF THE INVENTION

The purpose of the invention is to provide a spring terminal fitted with a stop consisting of a looped spring, that also positions the electrical wire in addition to the traditional stop function. This stop is prevented from moving sideways with respect to the spring and it is housed in the two adjacent spring terminals.

The terminal according to the invention includes a spring stop that is bent to fit inside the spring loop, and to form wire guide means outside the loop adjacent to the flange of the support part.

According to another characteristic, the terminal is formed of two parts connected to each other inside the spring loop.

According to another characteristic, the spring stop forms two stop pins connected to two hubs assembled to each other and fixed to two half-shells forming a wire guide dish, these two half-shells being connected to each other by a bending membrane.

BRIEF DESCRIPTION OF THE DRAWINGS

The invention will now be described in more detail with reference to an embodiment given as an example and represented by the attached drawings on which.

DETAILED DESCRIPTION OF THE PREFERRED EMBODIMENTS

Figure 1A:
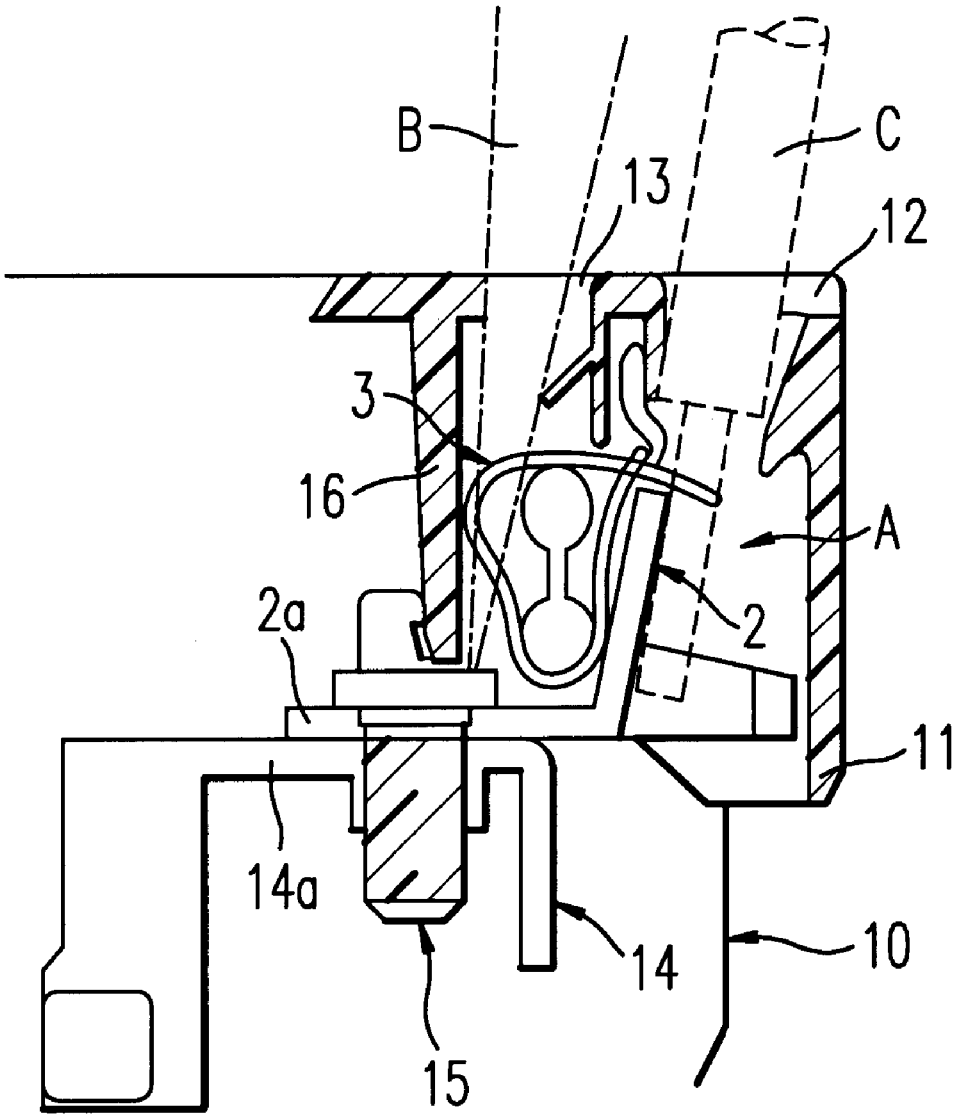
FIG. 1 shows a partial cross-sectional view of an electrical device containing a terminal according to the invention.
Figure 1B:
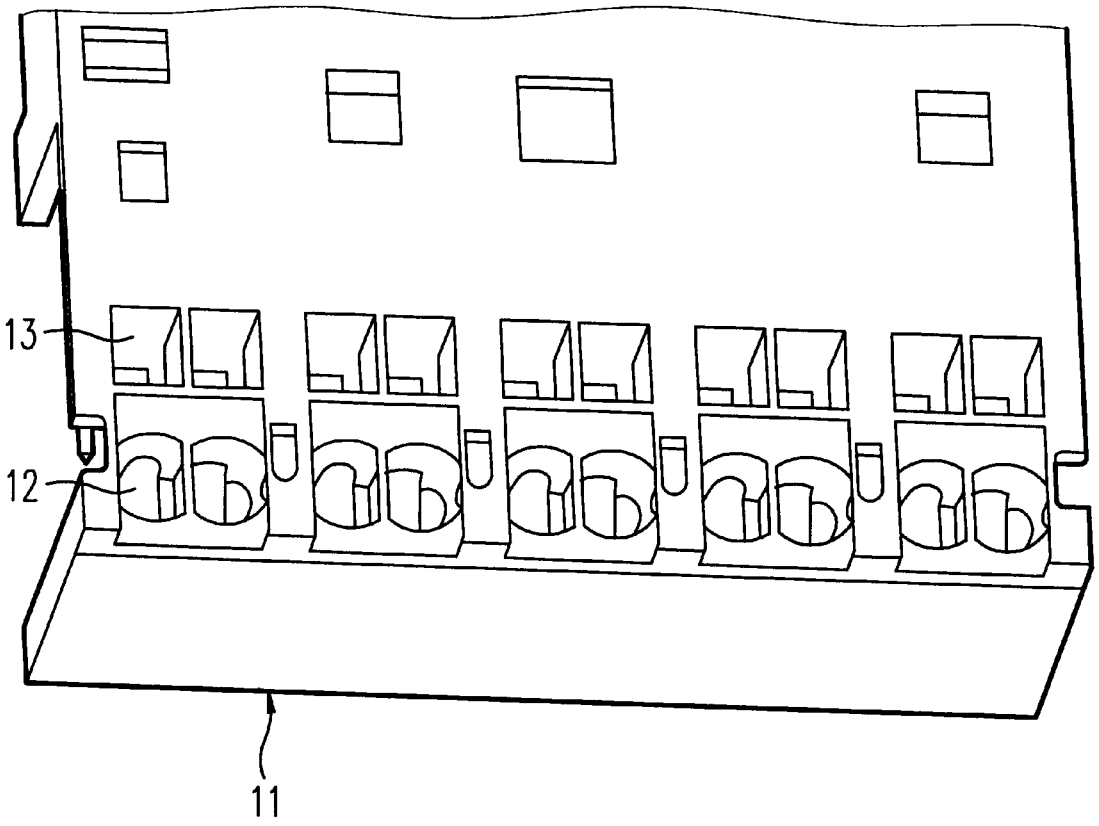
Figure 2:
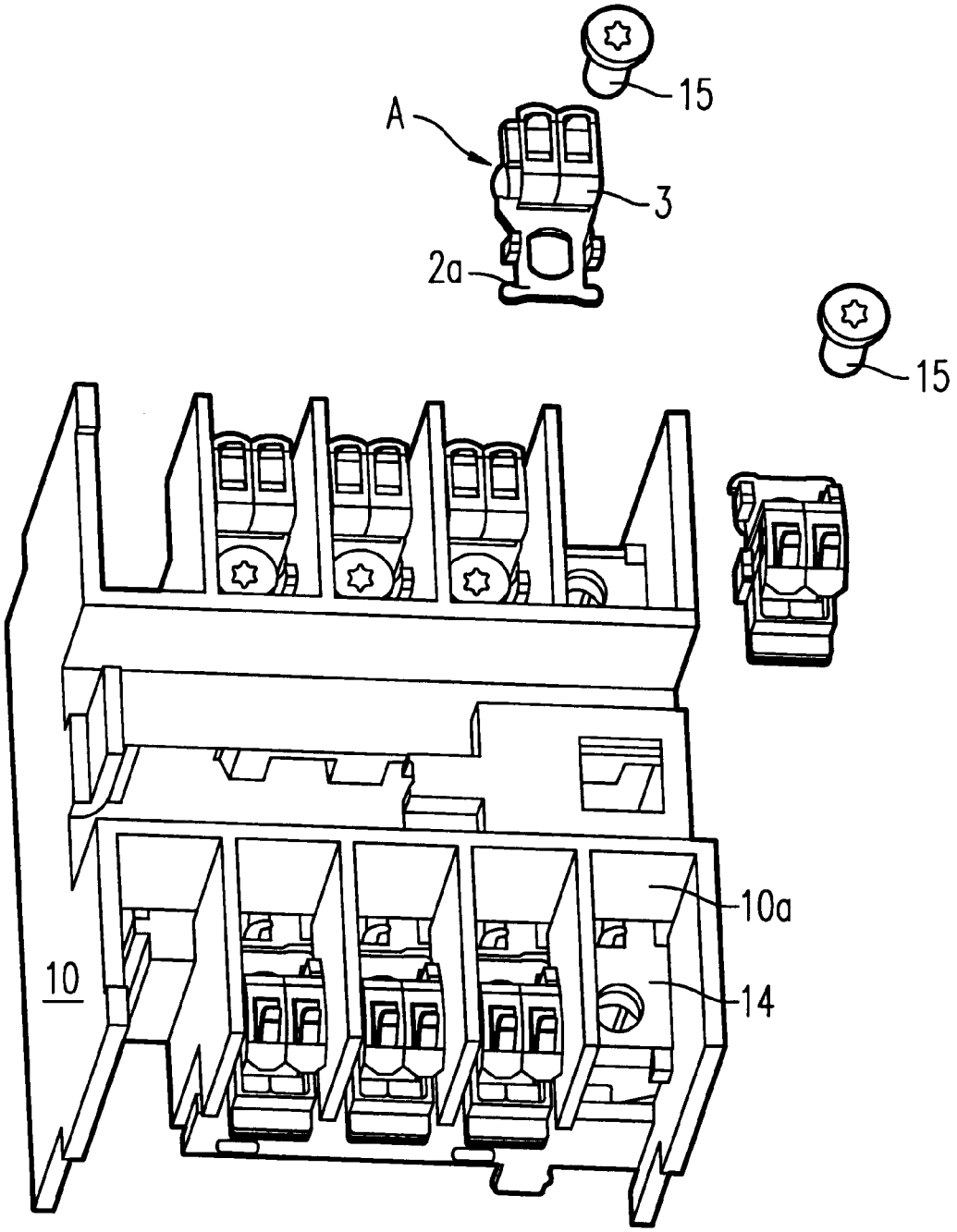
FIG. 2 is a perspective view of the electrical device in FIG. 1.
Figure 3:
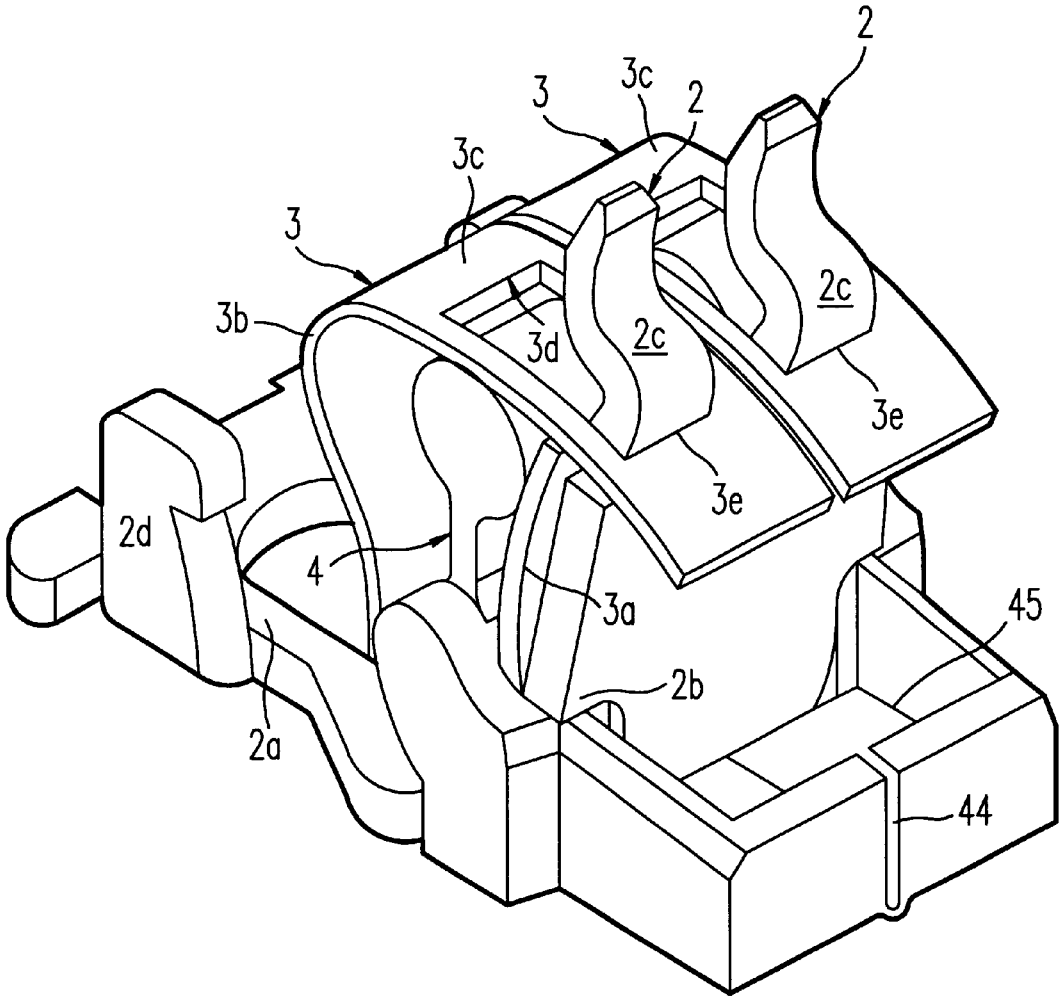
FIG. 3 is a perspective view of a double terminal with two springs.
Figure 4:
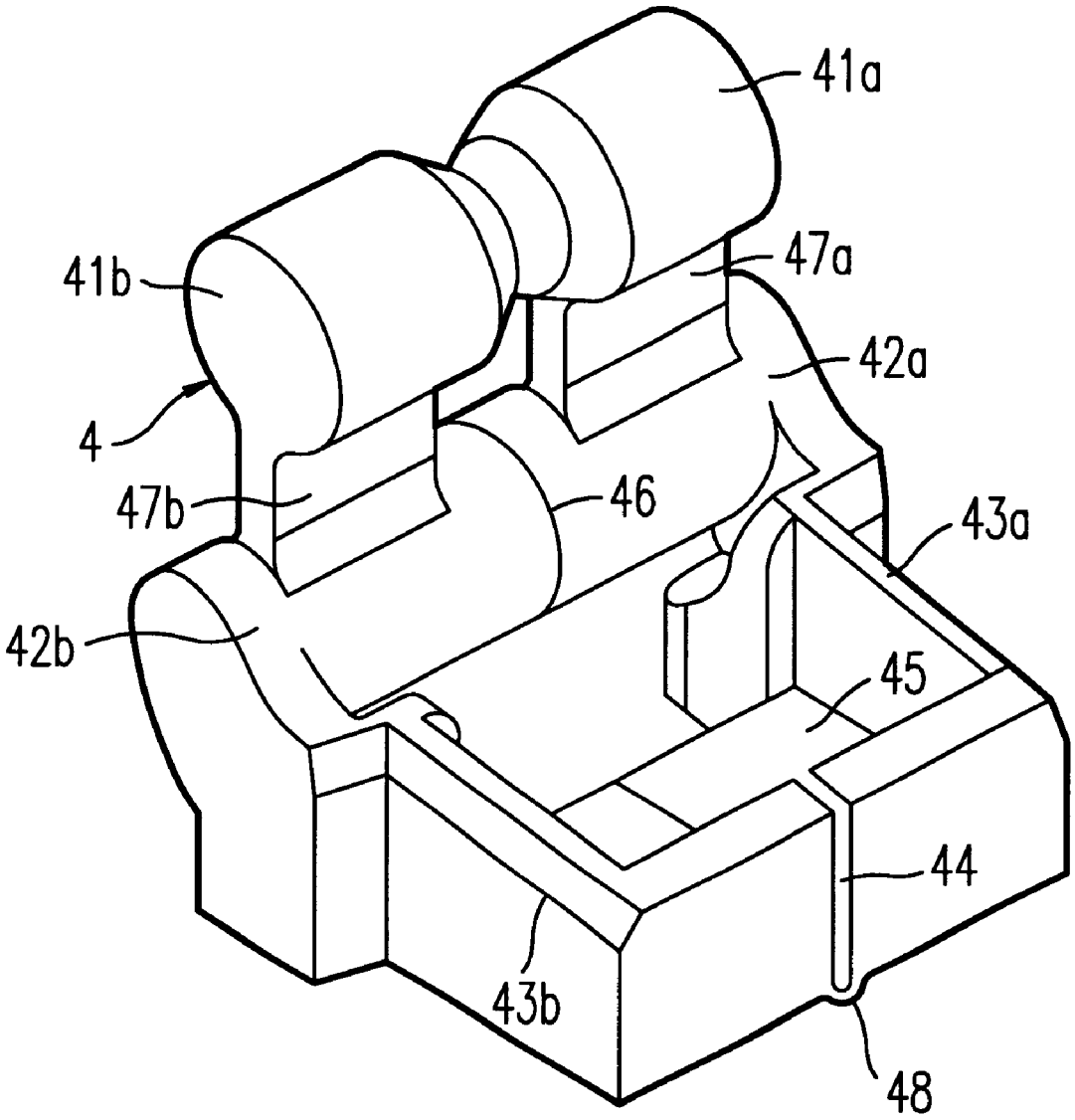
FIG. 4 is a perspective view of the stop in position in the terminal in FIG. 2 and shown in the folded position.
Figure 5:
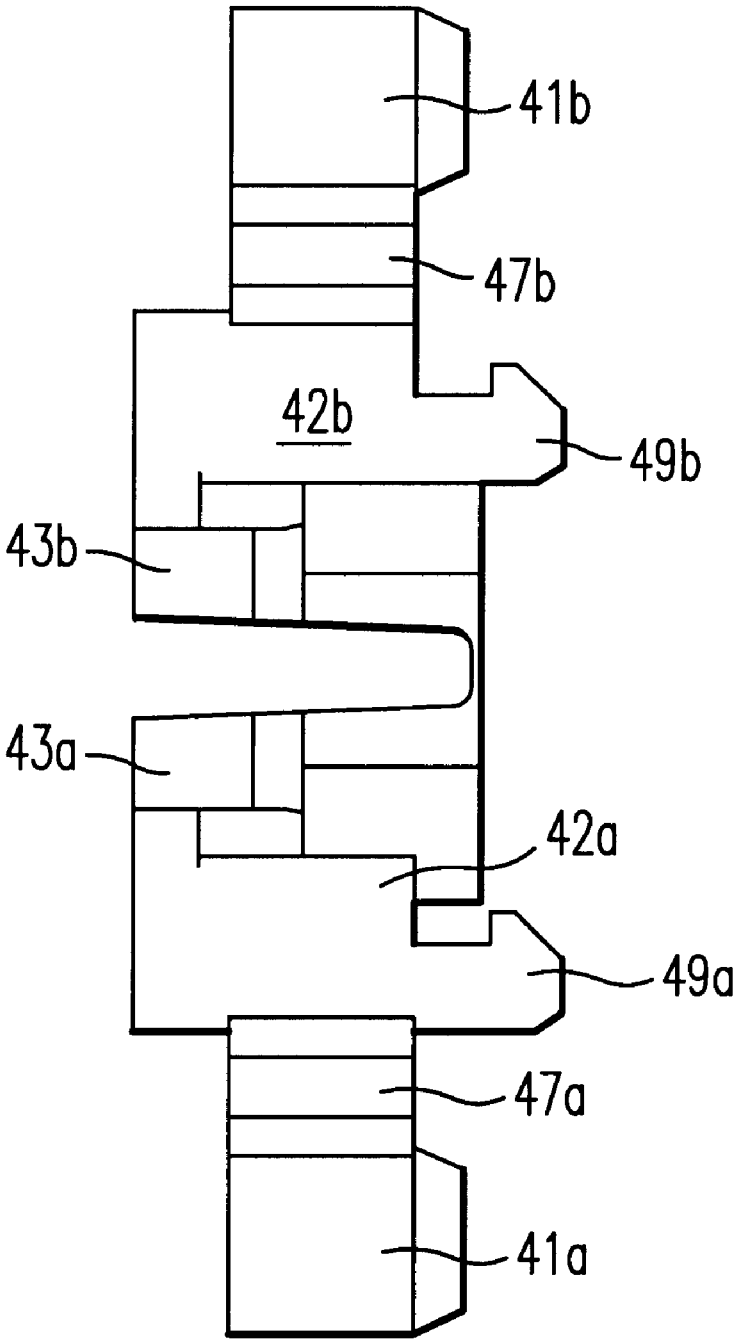
FIG. 5 is a view of the spring stop in FIG. 3, shown unfolded.

The electrical device, part of which is shown diagrammatically in FIG. 1, comprises a housing made of an insulating material 10 forming chambers 10*a* in which are lodged spring terminals A. In each chamber is lodged a conducting support part 14 on which there is a fixed contact.

The top of the housing 10 and the chambers are protected by a cover 11 or a similar covering device. This cover 11 is provided with an orifice 12 into which the electrical wire C to be connected to terminal A is inserted, and an orifice 13 through which a tool B is inserted in order to press on the spring in order to insert the electrical wire and to connect it.

The terminal mark A is generally fixed by means of a conducting support part 2 on a main conducting part 14 on which there is a fixed contact. This conducting support part 2 is in the general shape of a V and comprises a flange 2*b* to be used for guidance and for the connection and a second flange 2*a* used for the attachment. This attachment flange 2*a* is fixed to the connection strip 14*a* of the conducting part 14 by means of a screw 15 that screws into a threaded hole formed in the connection strip 14*a*. The flange 2*b* forms a guidance arm for the electrical wire C. The flange 2*b* has two teeth 2*c* that are curved so as to . . . The flange 2*a* has two upstands 2*d* that keep the partition 16 forming part of the housing or the cover of the switch in position.

Terminal A comprises at least one clamping spring 3 folded in the form of a loop. It is composed of a bearing flange 3*a* that is in contact with the flange 2*b* of the conducting support part, a clamping flange 3*c* and another flange 3*b* that forms a spring. The clamping flange 3*c* is provided with a clamping window 3*d* into which a tooth 2*c* of flange 2*b* penetrates and remains engaged. This clamping window 3*d* has an edge 3*e* that bears on an edge of the flange 2*b*–2*c*. When a conductor C is engaged in the window 3*d* between the edge 3*b* and the flange 2*b*–2*c*, it remains trapped between this edge 3*e* and the flange 2*b*–2*c* such that the electrical contact is made.

Terminal A illustrated on the drawings is a double terminal that comprises two springs mounted adjacent to each other.

The terminal comprises a spring stop 4 that is housed partly inside the two springs 3, surrounds the flange 2*b* and forms a guide dish 45 for the electrical wire C, this dish being adjacent to flange 2*b*. This stop 4 is made of a plastic material that is composed of two stop pins 41*a* and 41*b* in the form of a cylinder inside the loop, and which are connected through connecting rods 47*a* and 47*b* to two hubs 42*a* and 42*b* connected to each other. These two hubs 42*a* and 42*b* are fixed to two half-shells 43*a* and 43*b* which are connected to a folding membrane 48 and are separated by a slit 44. These two half-shells surround the flange 2*b* and form a dish 45 used to guide the end of the electrical wire C. The two hubs 42*a* and 42*b* are provided with assembly hooks 49*a* and 49*b* that connect them to each other along a joint 46. The stop pins 41*a* and 41*b* are placed close to windows 3*d*, whereas the hubs 42*a*–42*b* are adjacent to the folding curvature between flanges 3*a* and 3*b*.

The operation will now be described.

During assembly, the two springs 3 are positioned on flange 3*b* and the stop 4 is then folded around membrane 48 in order to bring pins 41*a* and 41*b* to face each other in the springs 3. The stop is held in place inside the spring loops and does not surround totally the spring. The terminal A is lodged between the partitions of a chamber and is fixed by the flange 2*a* on the conducting part 14 which is flush in this chamber.

When an operator wants to connect an electrical wire C, he presses with the screwdriver B onto flange 3*b* on one of the two springs 3. The edge 3*e* of the window moves away from flange 2*b* which creates a space inside which the operator can slide the electrical wire C. When he removes the screwdriver, the edge 2*e* of the window traps the wire C by pushing it into contact with flange 2*b* and making the electrical contact.

Obviously, it would be possible to imagine variants and improvements to detail, and even to consider the use of equivalent means, without going outside the framework of the invention.

What is claimed is:

1. A spring connection terminal for an electrical device comprising:

a conducting support part fixed to a main conducting part, and at least one clamping spring folded into a loop and provided with a clamping window inside which a flange of said support part passes, said spring connection terminal including a spring stop forming two stop pins respectively connected to two hubs, said spring stop being folded so as to be housed inside said spring loop for guiding a wire positionable in proximity with said flange outside said loop, wherein said stop pins are respectively fixed to two half-shells for forming a wire guide dish, and wherein a folding membrane is provided which connects said two half-shells to each other.

2. The spring terminal according to claim 1, wherein said conducting support part comprises a V-shaped part and said conducting part has a guidance and conducting flange and a second attachment flange.

3. The spring terminal according to claim 1, wherein said spring stop comprises two parts connected to each other inside said spring loop.

4. The spring terminal according to claim 1, wherein said hubs each include and assembly a hook for connecting said hubs to each other.

5. The spring terminal according to claim 1 or 2, wherein said spring terminal comprises two springs mounted in proximity with each other.

6. The spring connection terminal according to claim 1, wherein each said spring comprises a bearing flange contacting said conducting flange of said conducting support part, a clamping flange with a clamping window and a flange which forms said spring.

7. The spring connection terminal according to claim 1 or 2, wherein said attachment flange is fitted with upstanding members holding at least one of a partition of a housing or a switch cover in position.

* * * * *